US006621990B1

(12) United States Patent
Beehler et al.

(10) Patent No.: US 6,621,990 B1
(45) Date of Patent: Sep. 16, 2003

(54) METHOD FOR DETERMINING AIR DENSITY

(75) Inventors: James O. Beehler, Brush Prairie, WA (US); Todd R. Medin, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/198,285

(22) Filed: Jul. 17, 2002

(51) Int. Cl.[7] ..... G03G 15/00

(52) U.S. Cl. ..... 399/38; 73/30.01; 347/6

(58) Field of Search ..... 399/44, 46, 53, 399/69, 38; 355/30; 347/6; 73/30.01, 30.02, 30.03, 30.04

(56) References Cited

U.S. PATENT DOCUMENTS 4,662,622 A 5/1987 Wimmer et al.

*Primary Examiner*—Joan Pendegrass

(57) ABSTRACT

A method for determining a present air density for an imaging mechanism is presented. During a first time period: in a determining and storing action, a nominal air density is stored. In an increasing action, a fan input is increased until a known pressure in a cavity coupled to a fan receiving the fan input has been reached. In a determining and storing action, a nominal fan parameter is determined and stored after the known pressure is reached. During a second time period: in an increasing action, the fan input is increased until the known pressure in the cavity has been reached. In a determining action, a present fan parameter is determined after the known pressure is reached. In a calculating action, the present air density is calculated from the present fan parameter, the nominal fan parameter, and either the known pressure or the nominal air density.

23 Claims, 5 Drawing Sheets

METHOD FOR DETERMINING AIR DENSITY

INTRODUCTION

Imaging mechanisms may include inkjet devices, electrophotographic devices, dye sublimation devices, and lithographic devices. Each imaging mechanism has a series of subsystems which work together to enable the imaging mechanism to produce visible output on an imaging media. Examples of imaging subsystems, from different types of imaging mechanisms, include media transports, fusers, convective heaters, ink delivery systems, developers, and photoreceptors.

Scientists and engineers try to characterize the behavior of each subsystem in an imaging mechanism in order to properly control and improve its performance. Often, there are many "noise" factors which are related to a given subsystem's performance. Noise factors are factors which the imaging mechanism does not necessarily have control over. Examples of noise factors might be temperature, humidity, and/or air density. Such noise factors can have a dramatic effect on subsystem performance. At times, it may be practical to have a sensor to monitor a particular noise factor, such as a thermometer tied into an imaging mechanism's controller. In other situations, the cost or size of a particular sensor can be prohibitive. For example, a densitometer for measuring air density may be too expensive or too large to include in a given imaging mechanism.

Although it can be desirable for an imaging mechanism to know the air density, this factor must often be ignored, or assumed to be a nominal value around which the operation of subsystems sensitive to air density must be acceptable, if not able to be improved or optimized. As an alternate solution to having an air density sensor or ignoring air density altogether, some imaging mechanisms allow an operator to enter air density or altitude (which can be correlated to air density) directly into the imaging mechanism via some user interface. While this solution may be cost effective, it is subject to the availability and accuracy of the input made by the operator.

DETAILED DESCRIPTION OF THE PREFERRED EMBODIMENTS

Figure 1:
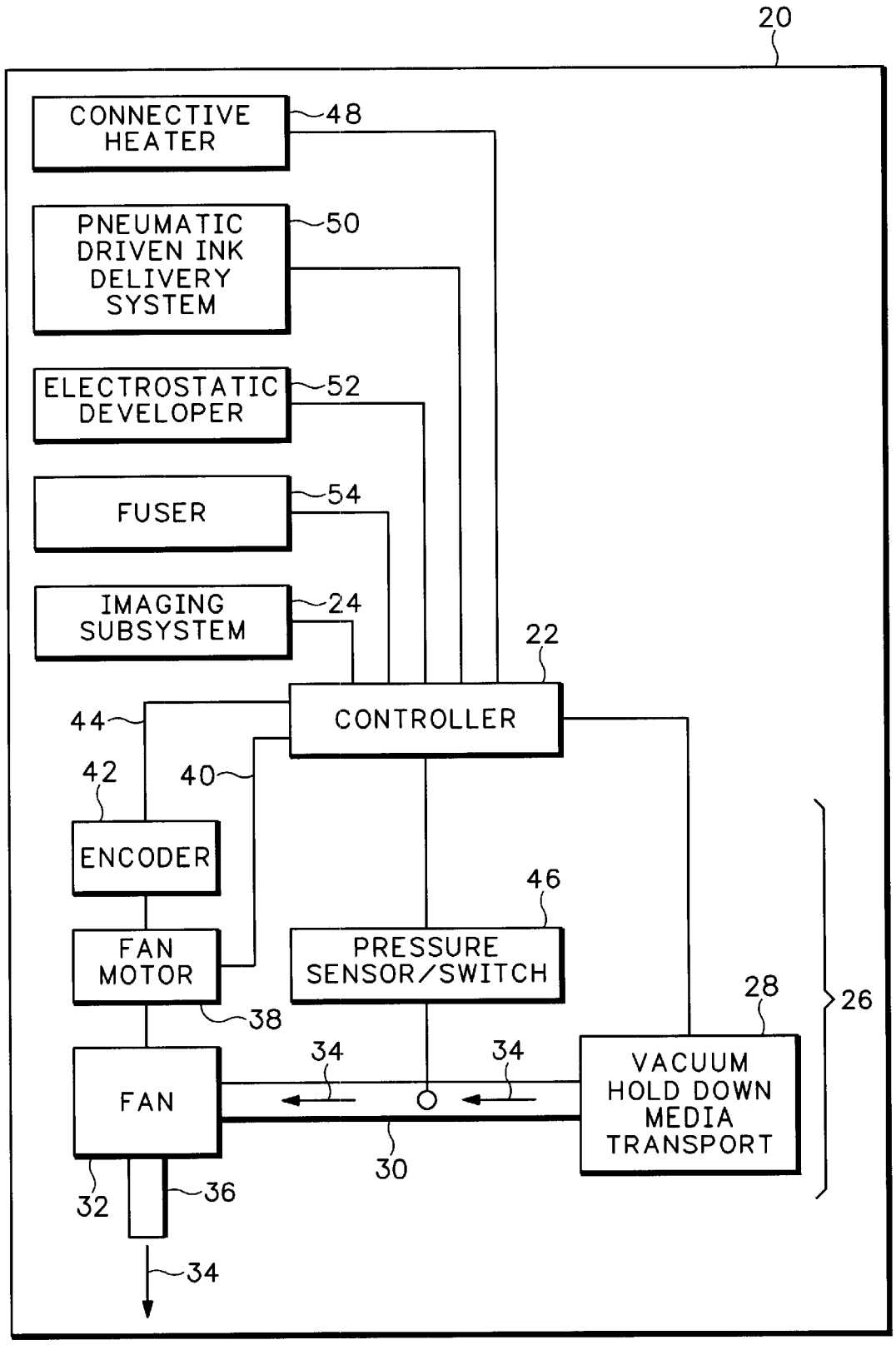
FIG. 1 schematically illustrates one embodiment of an imaging mechanism having subsystems.

FIG. 1 schematically illustrates one embodiment of an imaging mechanism 20 having subsystems. The imaging mechanism 20 may be used for imaging on a variety of media, such as paper, transparencies, coated media, cardstock, photo quality papers, and envelopes in an industrial, office, home or other environment. A variety of imaging mechanisms are commercially available. For instance, some of the imaging mechanisms that may embody the concepts described herein include desk top printers, portable printing units, wide-format printers, hybrid electrophotographic-inkjet printers, copiers, video printers, and facsimile machines, to name a few. For convenience the concepts introduced herein are described in the environment of an imaging mechanism 20.

The imaging mechanism 20 has a controller 22 which coordinates the operation of the various imaging subsystems 24 in the imaging mechanism 20. The controller 22 can be a microprocessor, application specific integrated circuit (ASIC), computer, digital components, and/or analog components, depending on the device and implementation. Often, an imaging mechanism 20 will have a media transport subsystem 26. In this embodiment, the media transport subsystem 26 includes a vacuum hold-down media transport 28. Such a vacuum media transport 28 may have a drum or a belt (not shown) with perforations or openings thereon which lead to a vacuum cavity 30. A vacuum may be created in vacuum cavity 30 by a vacuum fan 32 which is coupled to the cavity 30 and configured to remove air 34 from the cavity 30. The removed air 34 is expelled from an exhaust 36 coupled to the vacuum fan 32.

Torque is supplied to the vacuum fan 32 by a fan motor 38 to which it is coupled. The controller 22 controls a fan input 40 which drives the fan motor 38. The fan input 40 may be a variable voltage or current supplied by an amplifier, or it may be a pulse width modulation (PWM) signal or duty cycle. An encoder 42 is coupled between the fan motor 38 and the controller 22 in order to provide angular velocity feedback 44 to the controller 22 for the fan 32. Other position and time dependent sensors may be used in lieu of an encoder to provide velocity feedback 44. A pressure switch, or pressure sensor 46 is coupled between the vacuum cavity 30 and the controller 22. The pressure sensor 46 provides the controller 22 with a corresponding signal when a desired relative air pressure has been reached within the vacuum cavity 30 as compared to the air pressure outside the cavity 30.

The imaging mechanism 20 has other imaging subsystems 24, for example, a convective heater 48 for drying ink on an imaging media, a pneumatic-driven ink delivery system 50 for supplying ink to inkjet printheads, an electrostatic developer 52 for developing toner onto a photoreceptor in an electrophotographic process, and a fuser 54 for fusing toner onto an imaging media. Each of the imaging subsystems 24, 26, and 48–54 are coupled to the controller 22. Other imaging subsystems are known to those skilled in the art and may be included in alternate embodiments. Alternate embodiments may include a subset or superset of the imaging subsystems illustrated, or a completely different set of imaging subsystems altogether, provided there is a vacuum cavity 30, a pressure sensor 46, a means for changing the pressure in the vacuum cavity, such as fan 32 and a fan motor 38, or the functional equivalent of these elements. The illustrated subsystems 24, 28, and 48–54 are non-exhaustive examples of subsystems which may be affected by changes in air density. Those skilled in the art will be able to determine whether the performance of an imaging subsystem is affected by air density by using techniques such as designed matrix experiments and signal-to-noise analysis. Any subsystems which are affected by air density may be used in other embodiments.

Figure 2:
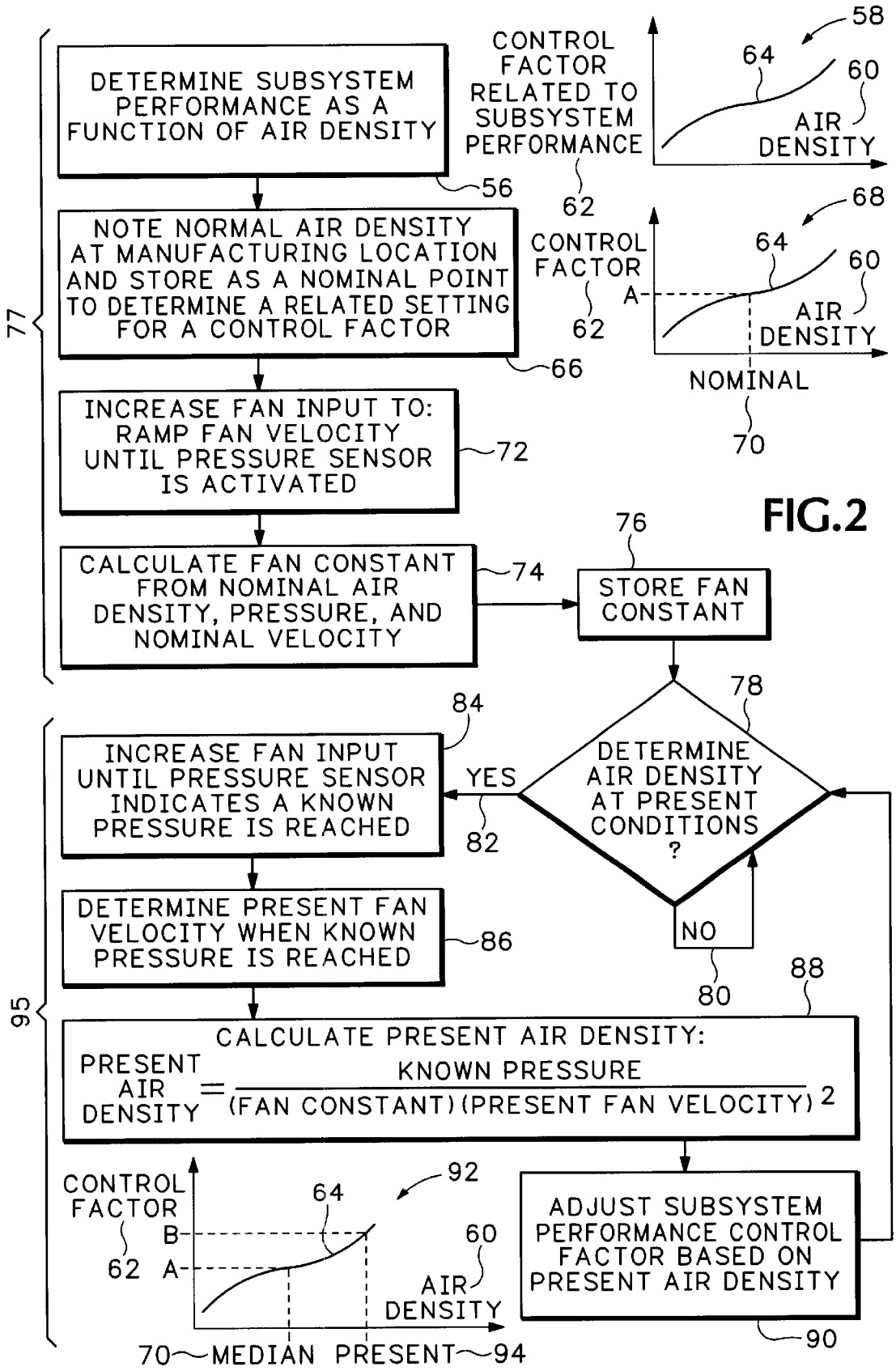
FIGS. 2–4 illustrate embodiments of actions which may determine an air density present at a given location and adjust a subsystem performance control factor based on the present air density.

FIG. 2 illustrates one embodiment of actions which may determine an air density present at a given location and adjust a subsystem performance control factor based on the present air density. The subsystem performance is determined 56 as a function of air density. Graph 58 illustrates how one such function might look. In the case of graph 58, as air density 60 increases, a control factor 62 related to system performance also increases according to the relationship of the curve 64 in graph 58. A nominal air density for a manufacturing location is measured 66 and stored as a nominal point to determine a related setting for a control factor. One way to have this nominal air density available to the imaging mechanism 20 is to store the nominal air density as a non-volatile memory (NVM) value which can easily be set once on a production floor and then burnt into a programmable memory of the controller of each imaging mechanism when it is built. Graph 68 illustrates a nominal air density value 70 and its corresponding control factor setpoint A, as determined by the relationship 64 between air density 60 and the control factor 62.

After building the imaging mechanism, during a calibration period, the fan's 32 input should be increased 72 to ramp the fan's velocity until the pressure sensor 46 is activated. Next, a nominal fan parameter, in this case, a fan constant can be calculated 74 from the nominal air density stored in NVM, the pressure level indicated by the pressure sensor 46, and the nominal velocity of the fan required to obtain that pressure level. The following equation may be used to calculate the fan constant:

$$K = \frac{P_k}{\rho_n \omega_n^2}$$

Where K is the fan constant, $P_k$ is the known static air pressure indicated by the switch during calibration, $\rho_n$ is the nominal air density, and $\omega_n$ is the nominal angular velocity of the fan needed to achieve the known static pressure during calibration. After calculating the fan constant, it is stored 76 for future use.

With reference to FIG. 2, actions 56, 66, 72, 74, and 76 take place during a first time period 77. At some later point in time, for example after a customer turns on their imaging mechanism 20, the controller can decide 78 whether or not to determine the air density at present conditions. If the controller 22 decides not 80 to determine the air density at a given time, it can reevaluate that decision 78 in the future. If the controller 22 decides 82 to determine the air density at present conditions, the fan input 40 is increased 84 until the pressure sensor 46 indicates the known pressure $P_k$ is reached. When the known pressure is reached, the controller determines 86 a present fan parameter, in this case, the present fan velocity, $\omega_p$. The controller may then calculate 88 the present air density, $\rho_p$ as follows:

$$\rho_p = \frac{P_k}{K\omega_p^2}$$

One or more subsystem performance control factors may then be adjusted 90 based on the present air density. Graph 92 illustrates one embodiment of how this adjustment might be determined. Graph 92 illustrates a nominal air density value 70 and its corresponding control factor setpoint A, as determined by the relationship 64 between air density 60 and the control factor 62. A determined present air density 94 is also shown, along with its corresponding control factor setpoint B, as determined by the relationship 64 between air density 60 and the control factor 62. Once setpoint B has been determined for the given imaging subsystem, the appropriate change to the control factor 62 may be made during the adjustment 90. With reference to FIG. 2, actions 84, 86, 88, and 90 take place during a second time period 95.

Figure 3:
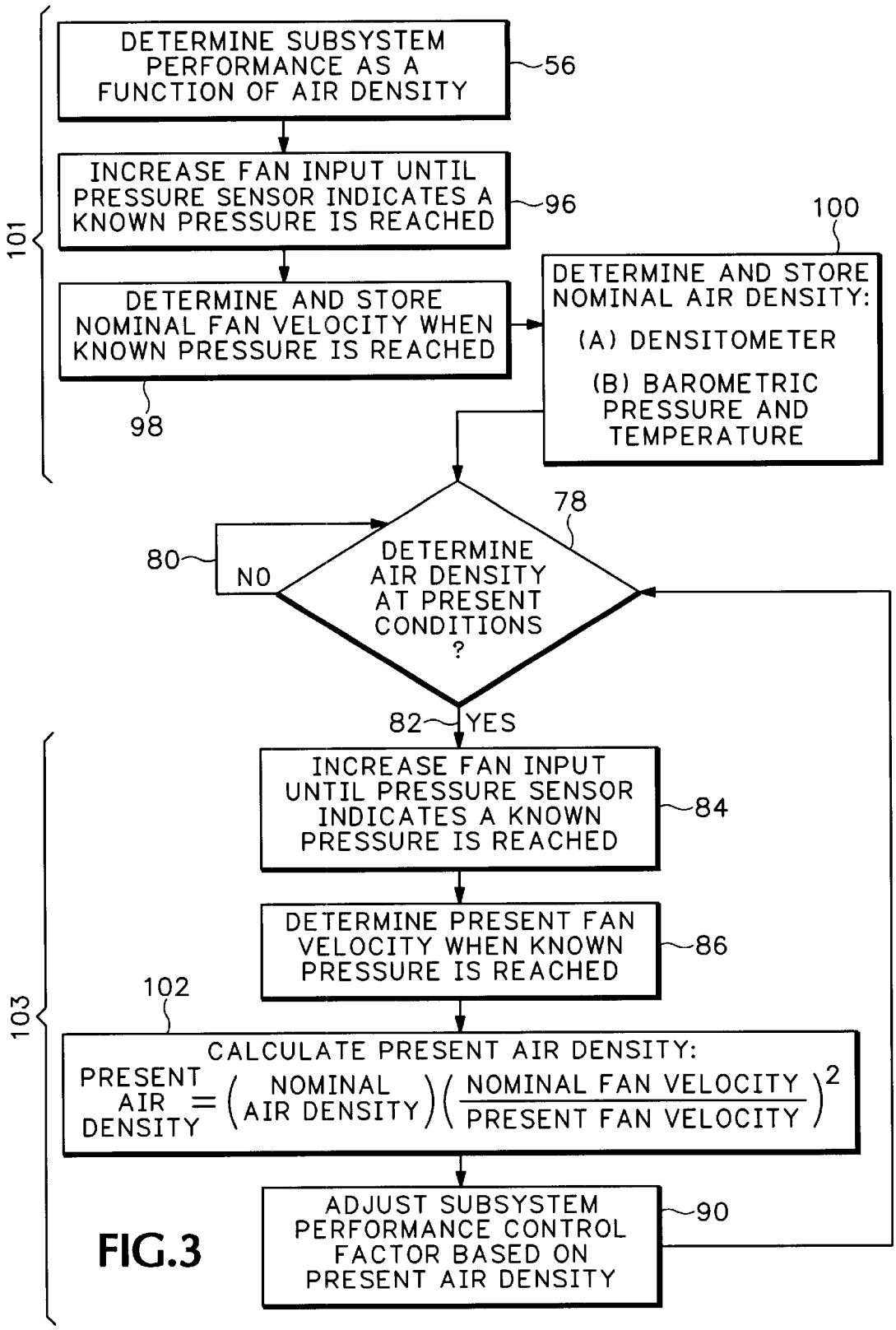

FIG. 3 illustrates another embodiment of actions which may determine an air density present at a given location and adjust a subsystem performance control factor based on the present air density. Subsystem performance is determined 56 as a function of air density, as previously described. During a calibration period, a fan input is increased 96 until the pressure sensor 46 indicates that a known pressure, $P_k$ is reached. Next, the controller determines and stores 98 a nominal fan parameter, in this case a nominal fan velocity $\omega_n$, when the known pressure is reached. A nominal air density $\rho_n$ is determined and stored 100. The nominal air density may be determined in many ways, for example, by using a densitometer which is not a part of the imaging device, or by calculating the nominal air density from a measured barometric pressure $P_B$ and temperature T. ($\rho_n = P_B/RT$, where R is the gas constant for air).

With reference to FIG. 3, actions 56, 96, 98, and 100 take place during a first time period 101. At some later point in time, for example after a customer turns on their imaging mechanism 20, the controller can decide 78 whether or not to determine the air density at present conditions. If the controller 22 decides not 80 to determine the air density at a given time, it can reevaluate that decision 78 in the future. If the controller 22 decides 82 to determine the air density at present conditions, the fan input 40 is increased 84 until the pressure sensor 46 indicates the known pressure $P_k$ is reached. When the known pressure is reached, the controller determines 86 a present fan parameter, in this case, the present fan velocity, $\omega_p$. The controller then calculates 102 the present air density, $\rho_p$ as follows:

$$\rho_p = (\rho_n)\left[\frac{\omega_n}{\omega_p}\right]^2$$

One or more subsystem performance control factors may then be adjusted 90 for the present air density as described previously with regard to FIG. 2. With reference to FIG. 3, actions 84, 86, 102, and 90 take place during a second time period 103.

Figure 4:
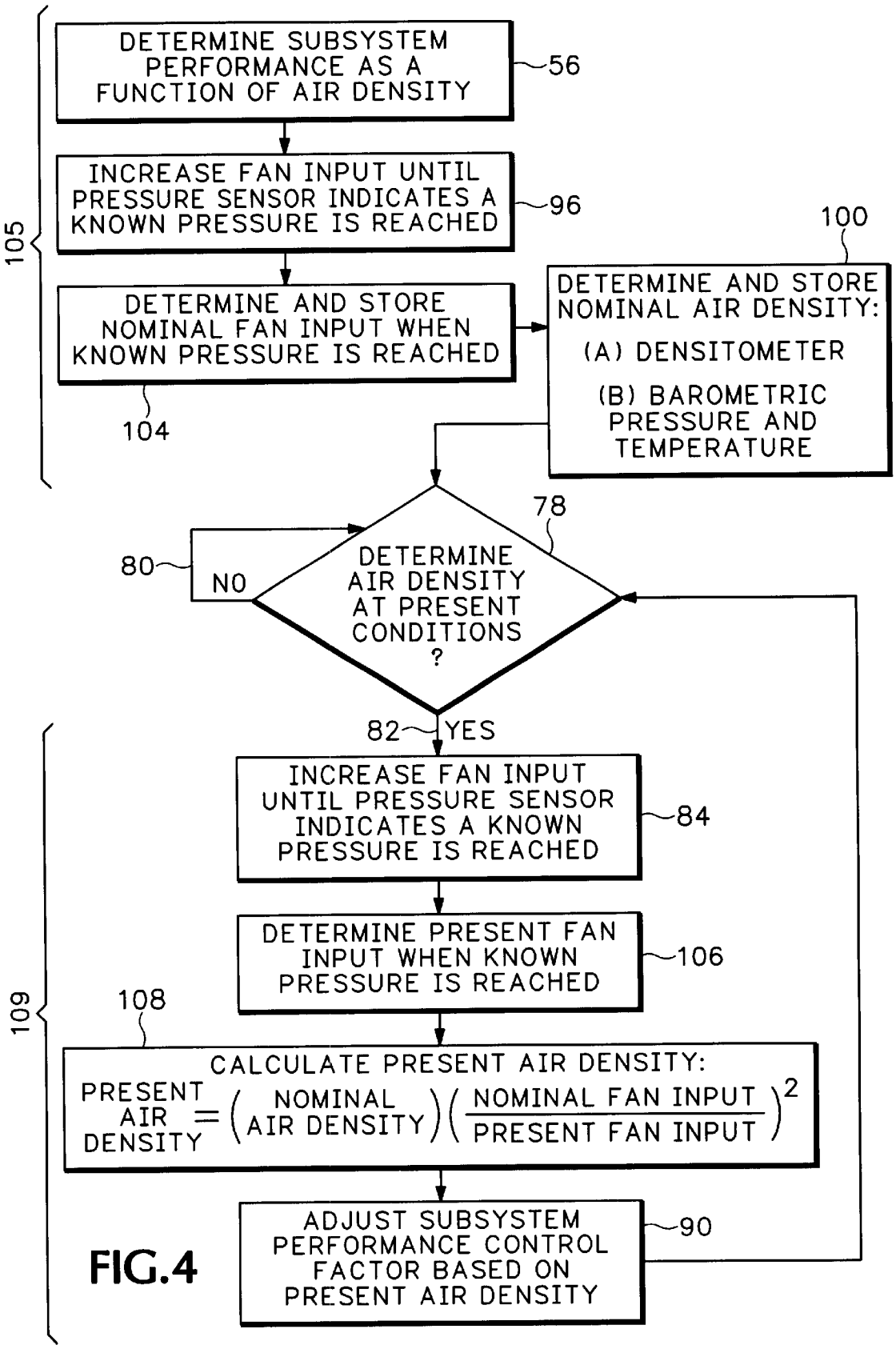

FIG. 4 illustrates another embodiment of actions which may determine an air density present at a given location and adjust a subsystem performance control factor based on the present air density. Subsystem performance is determined 56 as a function of air density, as previously described. During a calibration period, a fan input is increased 96 until the pressure sensor 46 indicates that a known pressure, $P_k$ is reached. Next, the controller determines and stores 104 a nominal fan parameter, in this case, a nominal fan input $I_n$ when the known pressure is reached. Some embodiments, such as the one in FIG. 4, may be able to use the fan input, rather than the angular velocity of the fan, since changes in the fan input may track changes in fan velocity over the expected operating range of the fan. Using fan input rather than fan velocity is advantageous because an encoder 42 or other position and time derivative feedback device is not needed and can be eliminated from the imaging mechanism 20. A nominal air density $\rho_n$ is determined and stored 100 as discussed above with regard to FIG. 3.

With reference to FIG. 4, actions 56, 96, 104, and 100 take place during a first time period 105. At some later point in time, for example after a customer turns on their imaging mechanism 20, the controller can decide 78 whether or not to determine the air density at present conditions. If the controller 22 decides not 80 to determine the air density at a given time, it can reevaluate that decision 78 in the future. If the controller 22 decides 82 to determine the air density at present conditions, the fan input 40 is increased 84 until the pressure sensor 46 indicates the known pressure $P_k$ is reached. When the known pressure is reached, the controller determines 106 a present fan parameter, in this case, the present fan input, $I_p$. The nominal fan input $I_n$ and the present fan input $I_p$ may be measured in units of current or voltage. The controller may then calculate 108 the present air density, $\rho_p$ as follows:

$$\rho_p = (\rho_n)\left[\frac{I_n}{I_p}\right]^2$$

For other embodiments, nominal fan input $I_n$ and the present fan input $I_p$ may be measured in other units beside voltage or current. An example of an alternate fan input is a controller parameter which controls the motor input, such as a pulse-width modulation (PWM) value. In the case of such alternate fan inputs, it is not necessarily desirable to square the ratio of the nominal fan input $I_n$ to the present fan input $I_p$ as in the above equation. Rather, in those cases, an empirically determined exponent may be desirable to apply to the $I_n/I_p$ ratio and can be determined by those skilled in the art.

One or more subsystem performance control factors may then be adjusted 90 for the present air density as described previously with regard to FIG. 2. With reference to FIG. 4, actions 84, 106, 108, and 90 take place during a second time period 109.

Figure 5A:
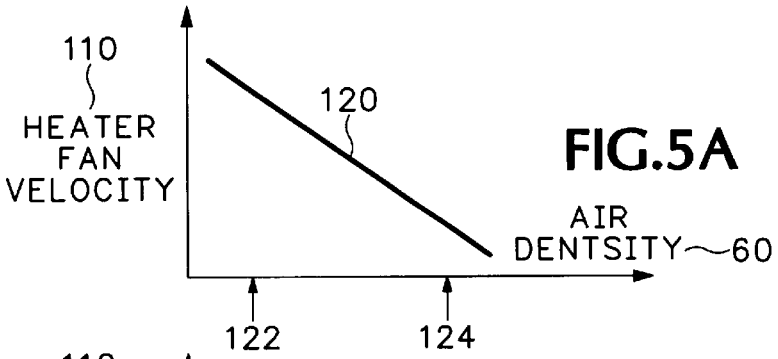
FIGS. 5A–5E illustrate possible relationships between subsystem performance control factors and air density.

FIGS. 5A–5E illustrate possible relationships between subsystem performance control factors and air density 60, thereby demonstrating some advantages available to an imaging mechanism 20 which has access to air density 60. The subsystem performance control factors illustrated in the embodiments of FIGS. 5A, 5B, 5C, 5D, and 5E are heater fan velocity 110, ink delivery pressure 112, vacuum transport fan velocity 114, ink drying time 116, and fuser temperature 118, respectively. An imaging mechanism 20 might not have all of these subsystems or even any of these subsystems. The concepts described herein could be applied to other imaging subsystems as well. FIG. 5A shows one embodiment of heater fan velocity 110 as a function of air density 60. Some imaging mechanisms 20 have a convective heating subsystem 48 which relies on a fan to circulate heated air to an imaging media in order to assist with the drying of ink. As used herein, the term "media" can refer to one or more medium. The proper velocity to set for the fan of a convective heating subsystem 48 may be dependant in part on air density 60. Heater fan velocity curve 120 illustrates one possible relationship of heater fan velocity 110 and air density 60. At a lower air density 122, there are fewer air molecules in a given volume of air, and therefore there are fewer heat carriers. Thus, the heater fan velocity curve 120 is higher at a lower air density 122 in order to deliver a desired amount of heat. Conversely, at a higher air density 124, there are more air molecules in a given volume of air, and therefore there are more heat carriers. Therefore, the heater fan velocity curve 120 is lower at a higher air density 124 because heat is more easily delivered.

Figure 5B:
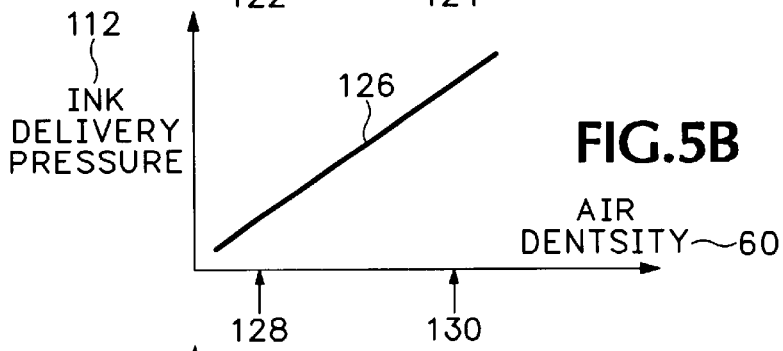

FIG. 5B shows one embodiment of ink delivery pressure 112 as a function of air density 60. Some imaging mechanisms 20 have a pneumatic driven ink delivery subsystem 50 which relies on pressure to transport ink through tubing or plumbing from a reservoir to an ink printhead. The proper pressure to set for the ink delivery subsystem 50 may be dependant in part on air density 60. Ink delivery pressure curve 126 illustrates one possible relationship of ink delivery pressure 112 and air density 60. At a lower air density 128, there are fewer air molecules in a given volume of air, and therefore less pressure outside the tubing of the ink delivery subsystem 50. Thus, the ink delivery pressure curve 126 is lower at a lower air density 128 because the subsystem will not need to pump as hard. Conversely, at a higher air density 130, there are more air molecules in a given volume of air, and therefore there is more pressure outside the tubing of the ink delivery subsystem 50. Therefore, the ink delivery pressure curve 126 is higher at a higher air density 130 because there is more external pressure.

Figure 5C:
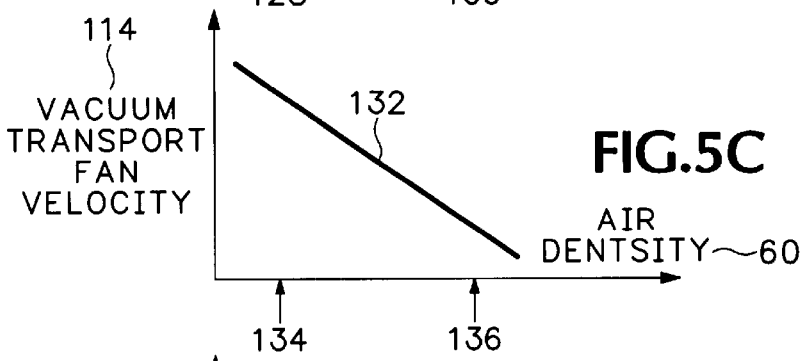

FIG. 5C shows one embodiment of vacuum transport fan velocity 114 as a function of air density 60. Some imaging mechanisms 20 have a vacuum holddown subsystem 28 which relies on a fan to remove air from a cavity coupled to a media transport. An appropriate pressure difference between the cavity side of the transport and the media side of the transport should be maintained to allow the media to stay in contact with the transport and yet still be stripped off when desired. The proper velocity to set for the fan of a vacuum holddown subsystem 28 may be dependant in part on air density 60. Vacuum transport fan velocity curve 132 illustrates one possible relationship of vacuum transport fan velocity 114 and air density 60. At a lower air density 134, there are fewer air molecules in a given volume of air, and therefore it is more difficult to move a given number of air molecules during each revolution of the fan. Thus, the vacuum transport fan velocity curve 132 is higher at a lower air density 134 in order to maintain a desired amount of fan throughput. Conversely, at a higher air density 136, there are more air molecules in a given volume of air, and therefore it is easier to move a given number of air molecules during each revolution of the fan. Therefore, the vacuum transport fan velocity curve 132 is lower at a higher air density 136 because air is more easily moved.

Figure 5D:
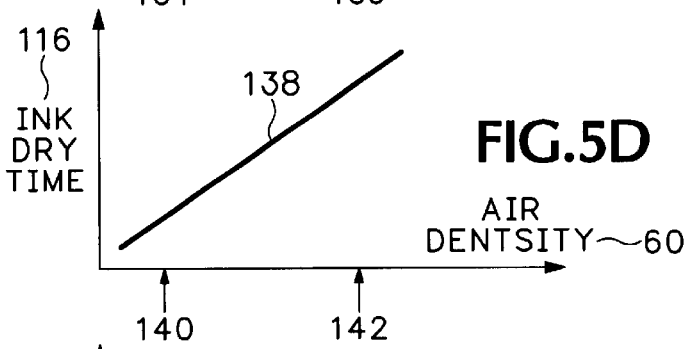

FIG. 5D shows one embodiment of ink drying time 116 as a function of air density 60. Some imaging mechanisms 20 use ink as the sole marking technology or in conjunction with other marking technologies, such as electrophotography. In these imaging mechanisms 20, the ink drying time 116 may be important to know, since stacking, finishing, or further imaging operations could require that the ink first be dry in order to prevent smearing. The proper ink drying time to set for the imaging mechanism 20 may be dependant in part on air density 60. Ink drying time curve 138 illustrates one possible relationship of ink drying time 116 and air density 60. At a lower air density 140, there are fewer air molecules in a given volume of air, and therefore there is more room for evaporated water or solvents. Thus, the ink drying time curve 138 is lower at a lower air density 140 because the water and/or solvents in the ink may evaporate more quickly. Conversely, at a higher air density 142, there are more air molecules in a given volume of air, and therefore there is less room for evaporated water or solvents. Therefore, the ink drying time curve 138 is higher at a higher air density 142 because the water and/or solvents in the ink may evaporate more slowly.

Figure 5E:
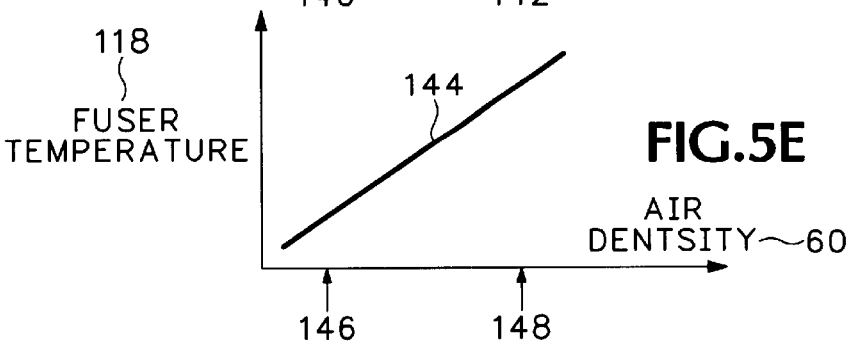

FIG. 5E shows one embodiment of fuser temperature 118 as a function of air density 60. Some imaging mechanisms 20, especially electrophotographic imaging mechanisms, have a fuser subsystem 54. In these imaging mechanisms 20, it may be important to know an appropriate setpoint for the fuser temperature 118 in order to enable proper toner adhesion to an imaging media without burning or charring the imaging media. The proper fuser temperature 118 to set for the imaging mechanism 20 may be dependant in part on air density 60. Fuser temperature curve 144 illustrates one possible relationship of fuser temperature 118 and air density 60. At a lower air density 146, there are fewer air molecules in a given volume of air, therefore there is more room for evaporated water or solvents, and therefore the imaging media may be dryer before entering the fuser subsystem 54. Thus, the fuser temperature curve 144 is lower at a lower air density 146 because the imaging media will be drier and therefore less fuser energy will be needed to drive water out of the imaging media and more of the available energy may be used to fuse the toner particles to the media. Conversely, at a higher air density 148, there are more air molecules in a given volume of air, therefore there is less room for evaporated water or solvents, and therefore the imaging media may be more moist before entering the fuser subsystem 54. Thus, the fuser temperature curve 144 is higher at a higher air density 148 because the fuser subsystem 54 may need to drive more water molecules out of the imaging media before energy can be effectively used to fuse the toner.

In discussing various embodiments for determining and using air density at a present location of an imaging mechanism, various benefits have been noted above. The imaging subsystems which may benefit from air density information are not limited to the embodiments included herein. All imaging subsystems may potentially benefit from knowing air density information. It is apparent that a variety of other functionally and/or structurally equivalent modifications and substitutions may be made to implement an embodiment for present air density determination according to the concepts covered herein, depending upon the particular implementation, while still falling within the scope of the claims below.

We claim:

1. A method for determining a present air density for an imaging mechanism, comprising:

during a first time period:

determining and storing a nominal air density;

increasing a fan input until a known pressure in a cavity coupled to a fan receiving the fan input has been reached; and determining and storing a nominal fan parameter after the known pressure is reached; and during a second time period:

increasing the fan input until the known pressure in the cavity has been reached;

determining a present fan parameter after the known pressure is reached; and calculating the present air density from the present fan parameter, the nominal fan parameter, and either the known pressure or the nominal air density.

2. The method of claim 1, wherein the nominal fan parameter is a fan constant calculated from a nominal velocity attained by the fan when the known pressure has been reached during the first time period, the nominal air density, and the known pressure.

3. The method of claim 2, wherein the present fan parameter is a present fan velocity attained by the fan when the known pressure has been reached during the second time period.

4. The method of claim 3, wherein calculating the present air density further comprises dividing the known pressure by the fan constant and the square of the present fan velocity.

5. The method of claim 1, wherein the nominal fan parameter is a nominal fan velocity attained by the fan when the known pressure has been reached during the first time period.

6. The method of claim 5, wherein the present fan parameter is a present fan velocity attained by the fan when the known pressure has been reached during the second time period.

7. The method of claim 6, wherein calculating the present air density further comprises multiplying the nominal air density by the square of a result of the nominal fan velocity divided by the present fan velocity.

8. The method of claim 1, wherein the nominal fan parameter is a nominal fan input with which the known pressure is reached during the first time period.

9. The method of claim 8, wherein the present fan parameter is a present fan input with which the known pressure is reached during the second time period.

10. The method of claim 9, wherein calculating the present air density further comprises multiplying the nominal air density by the square of a result of the nominal fan input divided by the present fan input.

11. The method of claim 10, wherein the nominal fan input and the present fan input are measured in terms of a pulse-width modulation (PWM) duty cycle.

12. The method of claim 11, wherein the nominal fan input and the present fan input are measured in terms of a current supplied to the fan.

13. The method of claim 11, wherein the nominal fan input and the present fan input are measured in terms of a voltage supplied to the fan.

14. The method of claim 1, further comprising:

during the first time period, determining an imaging subsystem performance as a function of air density; and during the second time period, adjusting an imaging subsystem performance control factor based on the present air density.

15. The method of claim 14, wherein the imaging subsystem performance control factor is selected from the group consisting of heater fan velocity, ink delivery pressure, vacuum transport fan velocity, ink drying time, and fuser temperature.

16. An imaging mechanism, comprising:

a vacuum cavity;

means for changing a pressure in the vacuum cavity;

a pressure sensor coupled to the vacuum cavity; and a controller configured to:

control the pressure changing means to produce a known pressure which is sensed by the pressure sensor; and calculate a present air density from parameters of the pressure changing means, and either the known pressure, or a nominal air density.

17. The imaging mechanism of claim 16, further comprising at least one ink printhead.

18. The imaging mechanism of claim 16, further comprising a convective heater subsystem which is coupled to the controller, wherein the controller uses the present air density to adjust a control factor for the convective heater subsystem.

19. The imaging mechanism of claim 16, further comprising a pneumatic driven ink delivery subsystem which is coupled to the controller, wherein the controller uses the present air density to adjust a control factor for the pneumatic driven ink delivery subsystem.

20. The imaging mechanism of claim 16, further comprising an electrostatic developer subsystem which is coupled to the controller, wherein the controller uses the present air density to adjust a control factor for the electrostatic developer subsystem.

21. The imaging mechanism of claim 16, further comprising a fuser subsystem which is coupled to the controller, wherein the controller uses the present air density to adjust a control factor for the fuser subsystem.

22. The imaging mechanism of claim 16, further comprising an imaging subsystem which is coupled to the controller, wherein the controller uses the present air density to adjust a control factor for the imaging subsystem.

23. A method, comprising:

during a first time period:

determining an imaging subsystem performance as a function of air density;

determining and storing a nominal air density;

increasing a fan input until a known pressure in a cavity coupled to a fan receiving the fan input has been reached; and determining and storing a nominal fan parameter after the known pressure is reached; and during a second time period:

increasing the fan input until the known pressure in the cavity has been reached;

determining a present fan parameter after the known pressure is reached;

calculating a present air density from the present fan parameter, the nominal fan parameter, and either the known pressure or the nominal air density; and adjusting an imaging subsystem performance control factor based on the present air density, wherein the imaging subsystem performance control factor is selected from the group consisting of heater fan velocity, ink delivery pressure, vacuum transport fan velocity, ink drying time, and fuser temperature.

* * * * *